US005595305A

United States Patent [19]

Hart

[11] Patent Number: 5,595,305

[45] Date of Patent: Jan. 21, 1997

[54] COLLAPSIBLE STORAGE CONTAINER

[76] Inventor: Michael J. Hart, 126 The Esplanade, Sylvania Heights, New South Wales, 2224, Australia

[21] Appl. No.: 412,566

[22] Filed: Mar. 29, 1995

[30] Foreign Application Priority Data

Mar. 29, 1994 [AU] Australia ..... PM4755

[51] Int. Cl.[6] ..... B65D 19/06; B65D 88/52

[52] U.S. Cl. ..... 206/600; 220/1.5; 220/4.29

[58] Field of Search ..... 206/600; 220/1.5, 220/4.29

[56] References Cited

U.S. PATENT DOCUMENTS

| | | | |
|---|---|---|---|
| 3,854,544 | 12/1974 | Kolchev | 220/4.29 X |
| 4,053,079 | 10/1977 | Karpisek | 220/1.5 X |
| 5,161,709 | 11/1992 | Oestreich, Jr. | 220/1.5 X |

FOREIGN PATENT DOCUMENTS

| | | | |
|---|---|---|---|
| 0169950 | 2/1986 | European Pat. Off. | 206/600 |
| 0678842 | 11/1991 | Switzerland | 206/600 |
| 2242891 | 10/1991 | United Kingdom | 206/600 |
| 2245883 | 1/1992 | United Kingdom | 206/600 |
| 093024379 | 12/1993 | WIPO | 206/600 |

*Primary Examiner*—Bryon P. Gehman

*Attorney, Agent, or Firm*—Sixbey Friedman Leedom & Ferguson; Thomas W. Cole

[57] ABSTRACT

A collapsible storage container has four walls hingedly connected with depending L-shaped hooks. The walls are moveable between a container configuration in which the L-shaped hooks captively engage a pallet which forms the base of an enclosure defined by the walls and a collapsed configuration in which the walls overlay one another in a substantially parallel arrangement. A roof is connected by hinges to one of the walls and is moveable between a closed position in which lugs engage an opposite wall and a storage position in which the roof is substantially parallel to wall.

7 Claims, 4 Drawing Sheets

COLLAPSIBLE STORAGE CONTAINER

This invention relates to storage and transport containers and more particularly to a collapsible storage container for use with a forklift pallet.

Forklift pallets are widely used as a means of transporting a wide variety of products. As will be well known to those skilled in the art, pallets are used for transport of goods that can be stacked on the pallet and then moved by means of a forklift truck which engages the pallet in a well known manner. A shortcoming of forklift pallets as a means of transporting goods is that they are largely confined to use with goods which can be readily stacked in a stable configuration on the pallet. Additionally, whilst it is common to consign a particular pallet of goods to a given location there is no means of ensuring, other than visually, that all of the goods originally stacked on the pallet arrive at the final destination. A further shortcoming of transport by means of pallets is that the goods stacked on the pallets are not in any way protected from damage or loss during transport other than by the packaging of the goods themselves. It is also the case that many types of goods stacked on pallets do not allow for the stacking of a further pallet of goods on top of the first pallet due to either potential damage to the goods or a lack of stability.

It is an object of this invention to provide a collapsible storage container for use with a forklift pallet which will overcome or at least ameliorate one or more of the foregoing difficulties.

Accordingly, in one aspect this invention consists in a collapsible storage container for use with a forklift pallet, said container comprising at least four hingedly connected wall members with at least two of said wall members including associated pallet engaging means, said hinged connections allowing said wall members to be moved to a container configuration in which said pallet is captively engaged by said engaging means as a base to an enclosure formed by said wall members, and allowing said wall members to be moved to a collapsed configuration in which at least some of said wall members are adjacent each other in a substantially parallel arrangement.

Preferably, the collapsible storage container further comprises of a roof member adapted to engage the wall members in the container configuration to close the roof of the enclosure. The roof member is preferably captively engaged by the wall members in the container configuration. In a preferred embodiment the roof member is hingedly connected to one of the wall members and can move between a roof position in the container configuration and a storage position in a collapsed configuration. In the storage position the roof member is substantially parallel to the wall member to which it is hingedly connected.

Two of the wall members preferably have free edges opposite the edges respectively hingedly connected to adjacent wall members. The container preferably includes locking means selectively operable to secure the free edges thereby locking the wall members in the container configuration. In a preferred embodiment the locking means operates at a single point. It will be apparent that in combination with the captively retained roof member this embodiment offers significant advantages in that the entire structure can be secured at a single point.

In accordance with a preferred embodiment the wall members overlay one another in the collapsed configuration.

The pallet engaging means preferably comprises L-shaped hooks depending from the walls members to engage the pallet. The hooks are preferably of two types. A first type engages the upper deck of the pallet and the other type spans and engages the joist of the pallet.

Preferably two of the storage containers can be stacked in the container configuration with the pallet forming the base of the uppermost storage container supported by the wall members of the lowermost storage case such that one of the wall members is free to move to allow access to the interior of the enclosure.

It will be apparent that the collapsible storage container of the present invention provides significant advantages for the transportation and storage of goods. In particular, the storage container when fitted to the pallet provides a enclosure which retains the advantage of palletised transportation whilst providing means for containing goods which could otherwise not be stably stacked on the pallet. Additionally, in accordance with embodiments of the invention a secure enclosure can be provided to ensure that all of the goods consigned on a particular pallet reach the final destination. In this connection a tamper evident device can be used in connection with the locking of the storage container. The storage container can also provide a degree of protection for goods stacked on the pallet. The preferred embodiments also provide for stacking of like storage containers when secured to a pallet irrespective of the contents of the container.

The storage container according to this invention also offers the advantages of being easily moved by a single person between the collapsed and container configurations. In collapsed configuration the container provides for easy transportation and storage. The storage container according to this invention can be formed from any suitable material. Examples include steel frames with plastics on the sides, all plastic construction, all aluminium construction, all kevlar (registered TM), combinations of the foregoing, or a cardboard construction with metal or plastic fittings and reinforcing.

One embodiment of the invention will now be described, by way of example only, with reference to the accompanying drawings in which.

Figure 1:
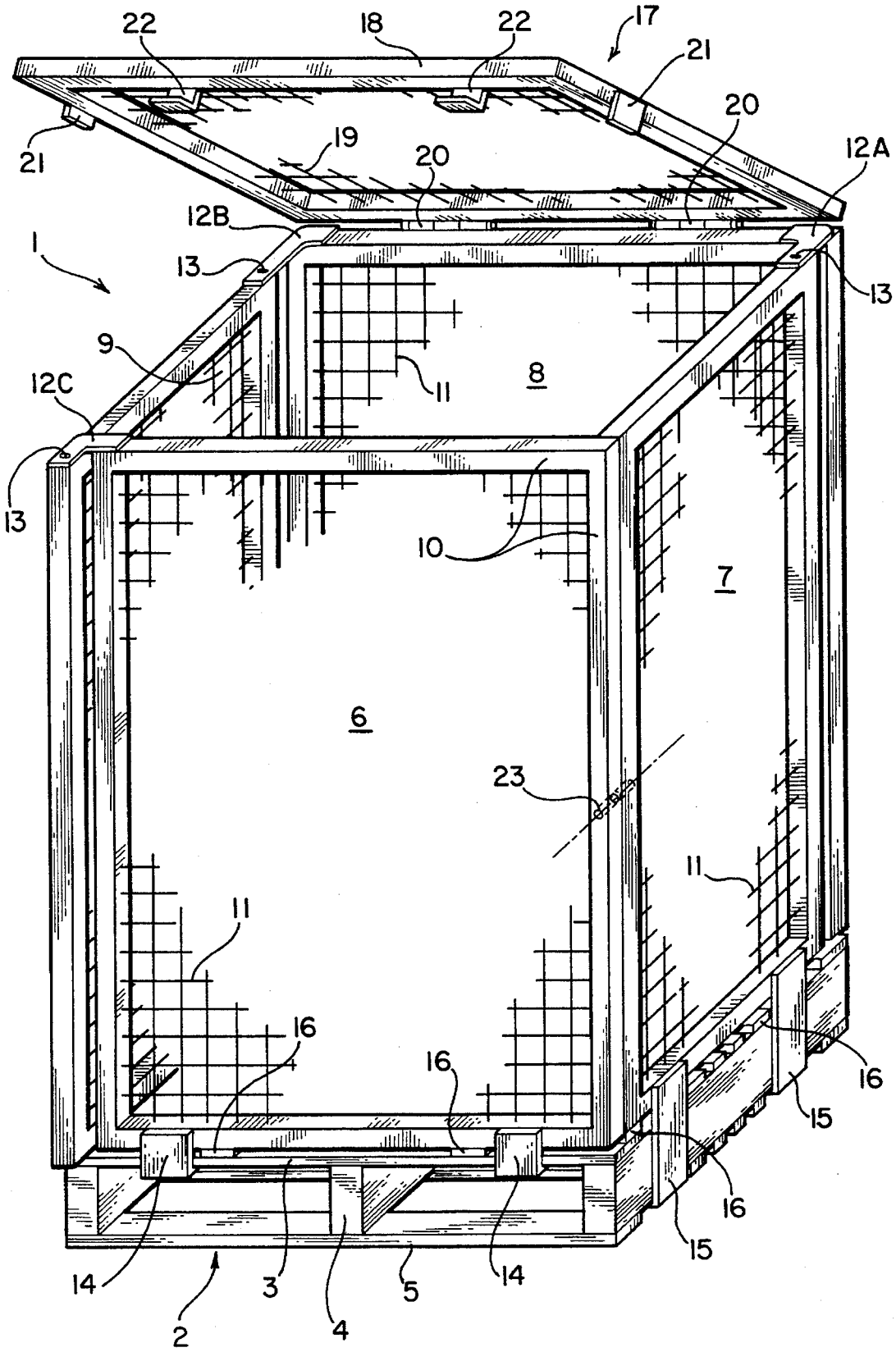
FIG. 1 is a perspective drawing of a collapsible storage container for use with a forklift pallet according to one embodiment of this invention.
Figure 2:
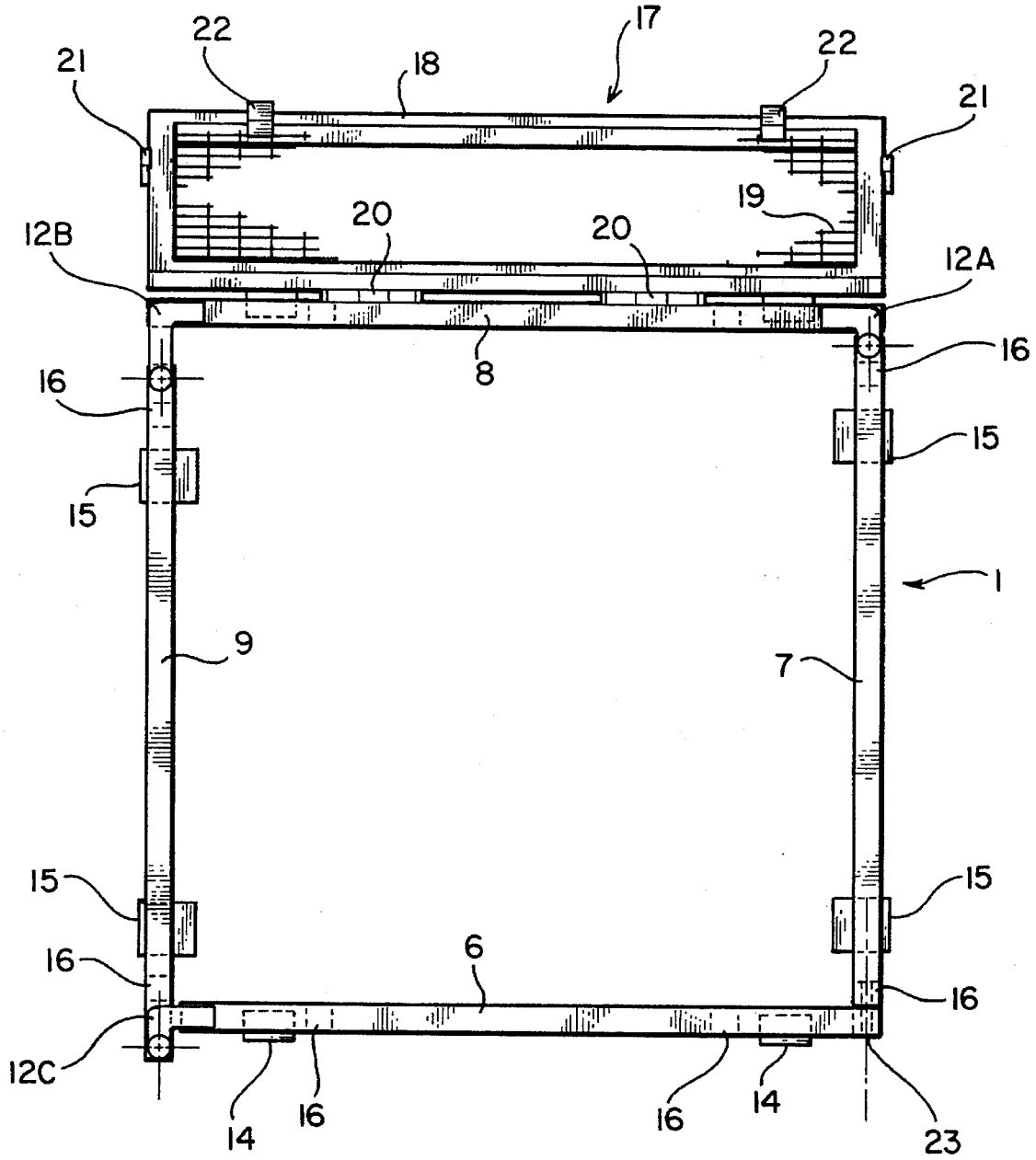
FIG. 2 is a plan view of the storage container shown in FIG. 1 without the pallet in place.

FIG. 1 shows the collapsible storage container of this invention 1 mounted with a forklift pallet 2 of known type. FIG. 2 is a plan view without the pallet and with the roof open. The forklift pallet is formed by upper deck members 3 secured to joists 4 and base members 5 also secured to the joists 4.

The storage container 1 is formed by four walls 6, 7, 8 and 9 hingedly connected together. The walls 6, 7, 8 and 9 are formed by frames 10 made from welded sections of rectangular hollow section steel. Infill panels 11 of steel mesh are welded to the respective frames 10.

Figure 6:
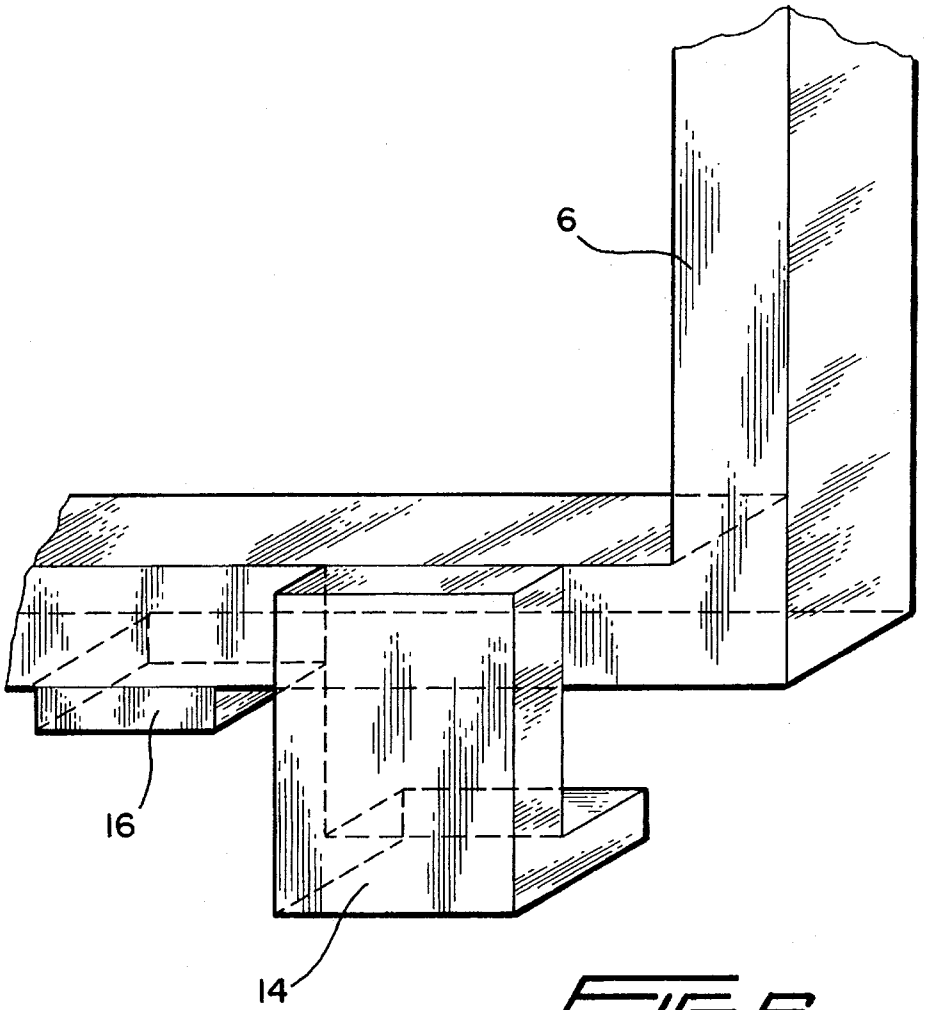
FIG. 6 is an enlarged view of a further part of the storage container shown in FIG. 1.
Figure 5:
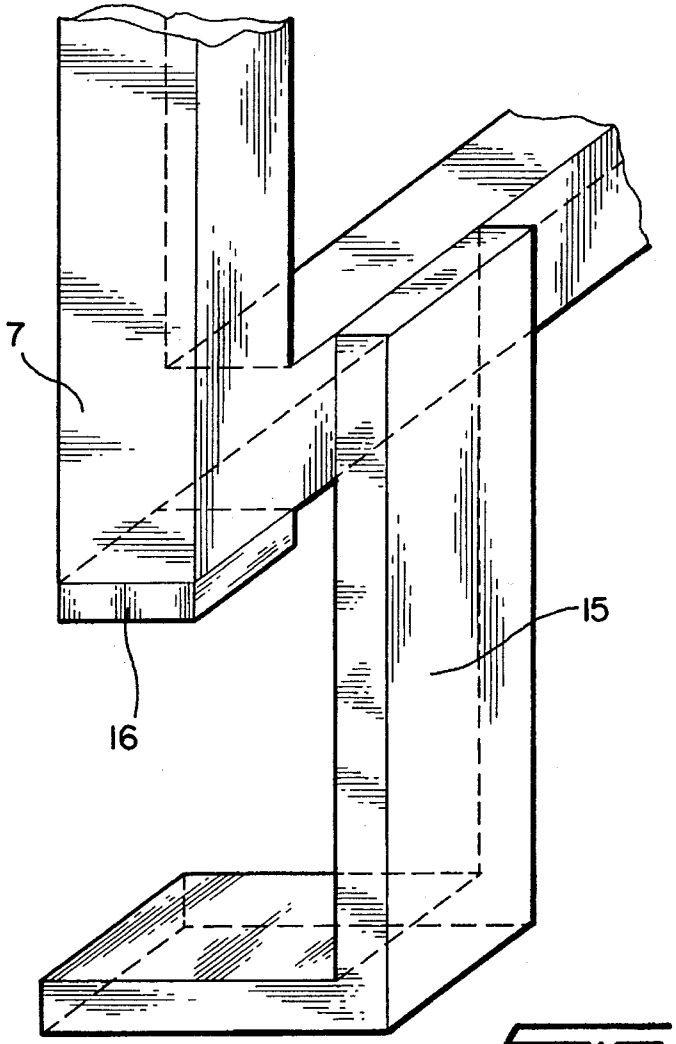
FIG. 5 is an enlarged view of part of the storage container shown in FIG. 1.

The hinged connection is provided by way of hinge members 12A, 12B, 12C which take the form of L-shaped flat brackets secured at one end to the respective frame member 10 by welding and at the other end pivotally connected to the adjacent frame member 10 by a pin 13 which protrudes into a hole (not shown). Two types of L-shaped hooks 14, 15 depend from the frame 10 of the walls 6, 7, 8, 9. FIGS. 5 and 6 respectively show the two types of hook. The hooks are formed by a L-shaped metal section welded to the frame 10. The two types of hook 14, 15 differ only in the length of the components of the L-shaped. As seen in FIG. 1 the hooks 14 are dimensioned to engage the upper deck 3 of pallet 2 whilst the hooks 15 are dimensioned to span and engage the joist 4. As shown in FIGS. 5 and 6, spacers 16 are welded to the frame 10 adjacent the hooks 14 and 15 to space the frames from the upper deck 3 of the pallet 2.

A roof member 17 is formed from a frame 18 and mesh infill panel 19 in the same manner as each of the walls. The roof member 17 is connected to the frame 10 of wall 8 by means of a pair of hinges 20 of a conventional door hinge type. Roof member 17 is provided with two types of locating lugs 21 and 22. In the closed position the fame 18 of roof member 17 overlies the adjacent portion of frames 10 of the walls 6, 7, 8, 9. Locating lug 21 and its counterpart extend past the frame 10 of walls 7 and 9 to positive locate the roof member 17 in alignment. The L-shaped lugs 22 extend under the adjacent frame 10 of wall 6 to prevent the roof member 17 being opened unless wall 6 is first displaced from the closed position. In this regard it will be apparent that the wall 6 must be moved outwardly from the position shown in FIG. 1 to facilitate movement of the roof 17 to the closed position. Once the wall 6 is subsequently moved to the closed position the roof 17 is captively engaged.

As seen in FIG. 1 the hinged connection of the walls members 6, 7, 8, 9 allows them to be moved so that the L-shaped brackets 14, 15 captively engage pallet 2. This is achieved by placing a pallet 2 on a flat surface and manoeuvring the container 1 into position whilst it rests on L-shaped hooks 15. When the container 1 is fitted to the pallet 2 as shown in FIG. 1, the walls 6, 7, 8, 9 form an enclosure with the pallet captively retained as the base of the enclosure. It will be apparent that the wall 6 functions as a door to the enclosure and can be opened without displacing any of the other walls or the roof 17. The free edges of walls 6 and 7 opposite the hinged connections with respective walls 8 and 9 can be secured by a lock 23 of any suitable type to retain the walls and roof in the container configuration. That is, a single point locking of the entire structure is provided.

Figure 3:
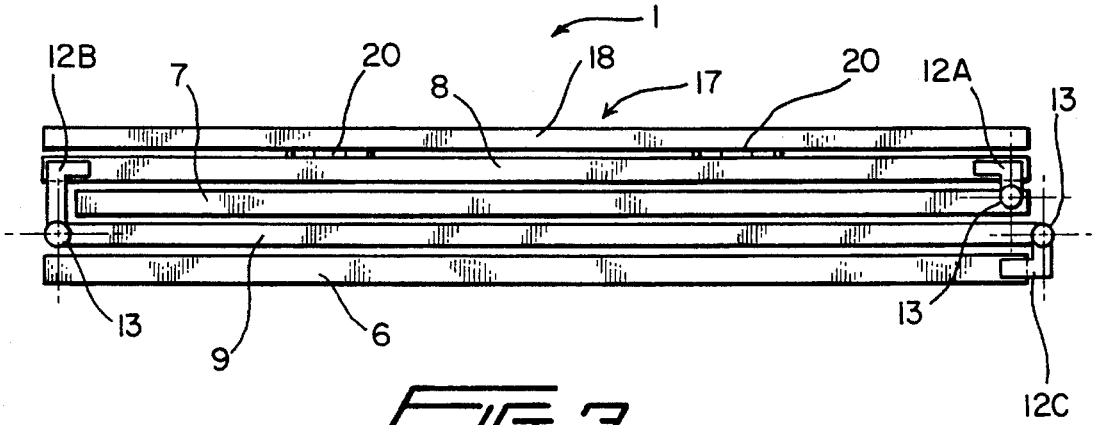
FIG. 3 is a plan view of the storage container of FIG. 1 in the collapsed configuration.
Figure 4:
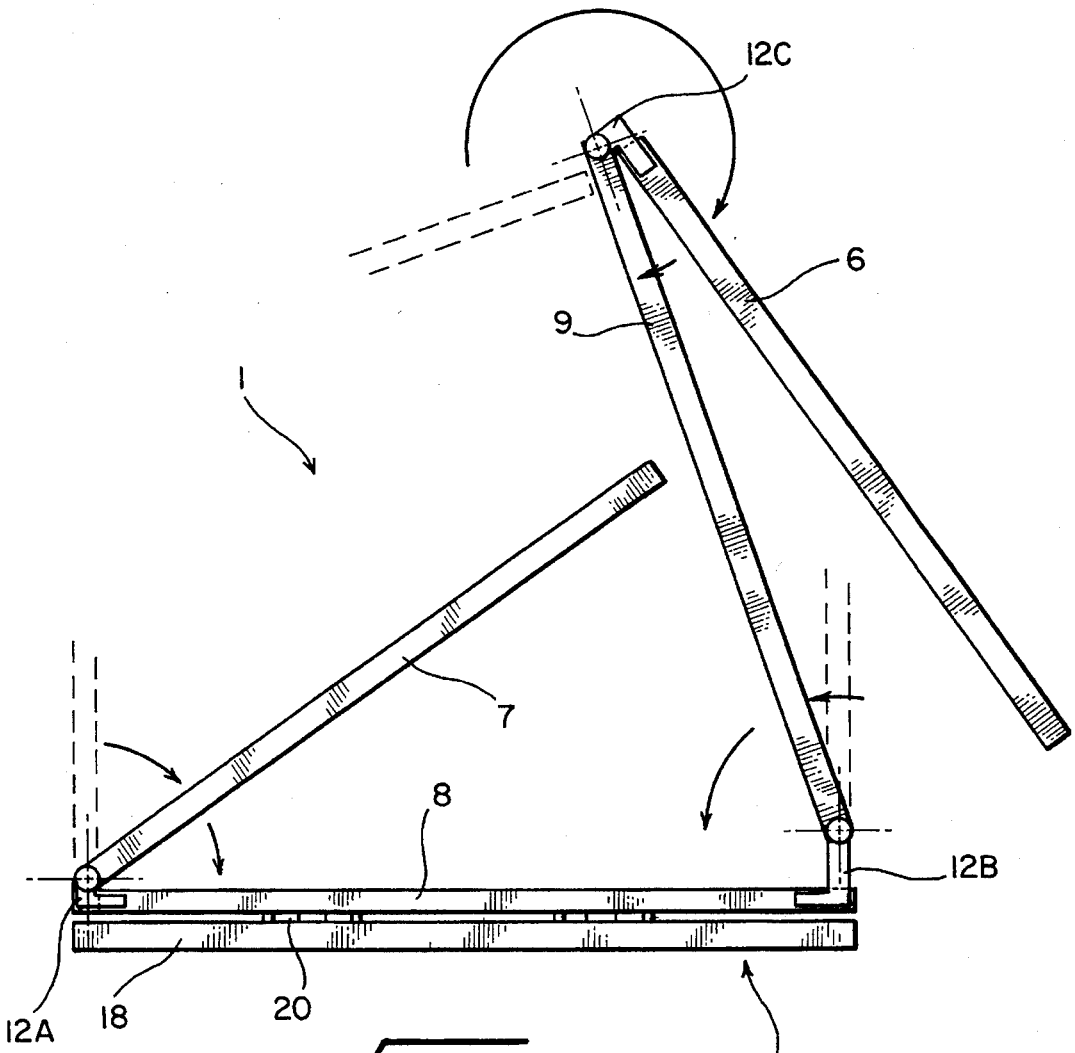
FIG. 4 is a plan view similar to FIG. 3 showing how the storage container is folded to the collapsed configuration.

FIG. 3 shows the container 1 in the collapsed configuration in which the respective wall elements 6, 7, 8, 9 and roof 17 overly each other in an adjacent substantially parallel arrangement. FIG. 4 shows how the container 1 is folded to the collapsed configuration. The roof 17 is rotated about hinges 20 to lie substantially parallel to wall 8. Wall 7 rotates about respective hinge 12A to lie adjacent and substantially parallel to wall 8. Wall 6 is moved through approximately 270° about hinge 12C to overlay the outer face of wall 9. Wall 9 is then rotated about hinge 12B to overlay wall 7. In this collapsed configuration the storage container of the present invention occupies a minimal volume for transportation and storage. It will be apparent that in order to achieve the folding described above the arm of hinge 12C is longer than that of corresponding hinges 12A and 12B to displace the pivot point outwardly by approximately the thickness of the frame 10. This allows wall 7 to be accommodated between walls 9 and 8 in the collapsed configuration. The gap necessary to achieve this configuration is not sufficiently large to present a practical problem in use.

It will be apparent that the container of the present invention when in the container configuration of FIG. 1 does not significantly protrude beyond the horizontal dimensions of a standard pallet 2. Additionally the manner of engagement of the hooks 14, 15 is such that the lifting and transportation of the pallet by means of a conventional forklift truck is not impaired.

Two storage containers 1 fitted to pallets 2 can be stacked one on top of the other. When so stacked the weight of the upper container is supported on frame 18 of roof member 17. The frame 18 is in turn supported by frame members 10 of respective walls 7, 8 and 9. This allows wall 6 to function as a door and allow access of the interior of the enclosure.

The foregoing describes only one embodiment of the invention and modifications can be made thereto without departing from the scope of the invention. For example, there is no necessity for the infill panels to be mesh and they can be formed from any suitable sheet material. It will also be apparent that the storage container according to this invention can be used for secure on-site storage. In this application shelving can be fitted to the container.

I claim:

1. A collapsible storage container comprising at least four wall members interconnected by intermediate hinged connections, with at least two of said wall members including respective engaging means for selectively engaging a forklift pallet, said hinged connections allowing said wall members to be moved to:

a container configuration in which a pallet is captively engaged by said engaging means as a base to an enclosure formed by said wall members; and a collapsed configuration in which at least some of said wall members are adjacent each other in a substantially parallel arrangement, said engaging means comprising generally L-shaped hooks depending from said wall members, said L-shaped hooks being of two types, one of said types being engageable with an upper deck of the pallet and the other of said types configured for spanning and engaging a joist of the pallet.

2. A collapsible storage container as claimed in claim 1 further comprising a roof member adapted to engage said wall members in the container configuration to define an upper limit to the enclosure.

3. A collapsible storage container as claimed in claim 2 wherein said roof member is captively engaged by said wall members in the container configuration.

4. A collapsible storage container as claimed in claim 3 wherein said roof member is hingedly connected to one of said wall members and can move between a roof position in the container configuration and a storage position in the collapsed configuration in which the roof member is substantially parallel to said one wall member.

5. A collapsible storage container as claimed in claim 1 wherein two of said wall members have free edges opposite edges that are respectively hingedly connected to adjacent wall members and wherein said container includes locking means selectively operable to secure said free edges thereby locking the wall members in said container configuration.

6. A collapsible storage container as claimed in claim 1 wherein said wall members overlay one another in said collapsed configuration.

7. A collapsible storage container as claimed in claim 1 wherein two of said storage containers can be stacked in the container configuration with the pallet forming the base of the uppermost storage container supported by wall members of the lowermost storage container such that one of said wall members is free to move to allow access to the interior of said enclosure.

* * * * *